US010394165B2

(12) United States Patent
Fujiwara

(10) Patent No.: US 10,394,165 B2
(45) Date of Patent: Aug. 27, 2019

(54) DEVELOPING DEVICE CARRYING LIQUID DEVELOPER

(71) Applicant: CANON KABUSHIKI KAISHA, Tokyo (JP)

(72) Inventor: Motohiro Fujiwara, Düsseldorf (DE)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/875,034

(22) Filed: Jan. 19, 2018

(65) Prior Publication Data

US 2018/0210373 A1 Jul. 26, 2018

(30) Foreign Application Priority Data

Jan. 20, 2017 (JP) ..... 2017-008952

(51) Int. Cl.
*G03G 15/10* (2006.01)
*G03G 15/11* (2006.01)
*G03G 15/16* (2006.01)

(52) U.S. Cl.
CPC ..... *G03G 15/104* (2013.01); *G03G 15/11* (2013.01); *G03G 15/161* (2013.01); *G03G 15/163* (2013.01); *G03G 15/1615* (2013.01); *G03G 15/1675* (2013.01)

(58) Field of Classification Search
CPC .. G03G 15/104; G03G 15/161; G03G 15/163; G03G 15/1675; G03G 15/11; G03G 15/1615
See application file for complete search history.

(56) References Cited

U.S. PATENT DOCUMENTS 7,693,461 B2 4/2010 Lee et al.
2006/0153597 A1* 7/2006 Guzman ..... G03G 15/104 399/237
2012/0195644 A1* 8/2012 Nelson ..... G03G 15/0808 399/237

FOREIGN PATENT DOCUMENTS

JP H10-282795 A 10/1998

* cited by examiner

*Primary Examiner* — David M. Gray
*Assistant Examiner* — Michael A Harrison
(74) *Attorney, Agent, or Firm* — Venable LLP

(57) ABSTRACT

A developing device includes a rotatable liquid developer carrying member, a developer container, an electrode opposed to the developer carrying member with a predetermined gap therebetween to form an electric field, and an urging roller provided downstream of the electrode and upstream of a developing position to urge the developer carrying member. An amount of toner on the developer carrying member per unit area in a region downstream of the urging roller and upstream of the developing position with respect to the rotational moving direction is not less than 50% of an amount of the toner on the developer carrying member per unit area in a region interposed between the electrode and the developer carrying member.

14 Claims, 7 Drawing Sheets

DEVELOPING DEVICE CARRYING LIQUID DEVELOPER

FIELD OF THE INVENTION AND RELATED ART

The present invention relates to a developing device for developing an electrostatic latent image carried on an image bearing member, using liquid developer including toner and carrier liquid, an image forming apparatus provided with the developing device, and liquid developer usable in the developing device.

An image forming apparatus which forms an image using liquid developer in which toner is dispersed in carrier liquid is known. In an example of the unknown apparatus, the liquid developer accommodated in a developer accommodation container is attracted to a developing roller by an electrode, and an electrostatic image formed on a photosensitive member is developed with the toner attracted by the developing roller in the liquid developer (Japanese Laid-open Patent Application Hei 10-282795). A structure in which a developer layer of the liquid developer carried on the developing roller by the electrode is compressed by a squeezing roller (U.S. Pat. No. 7,693,461).

If an amount of the toner moving toward the developing roller is small between the electrode as a film forming electrode and a developer carrying member in the form of the developing roller, an amount of the toner on the developing roller in a developing zone results in a decrease in a development efficiency, which is not desirable from the standpoint of high-speed operation.

SUMMARY OF THE INVENTION

Accordingly, it is an object of the present invention to provide a high-speed developing device.

According to an aspect of the present invention, there is provided a developing device comprising a rotatable developer carrying member configured to carry liquid developer including toner and carrier liquid to develop an electrostatic latent image carried on an image bearing member, with toner at a developing position; a developer container configured to store the liquid developer; an electrode provided opposed to the developer carrying member with a predetermined gap therebetween and configured to form an electric field for moving the toner in the liquid developer supplied from the developer container into the predetermined gap, toward the developer carrying member; and an urging roller provided downstream of the electrode and the upstream of the developing position with respect to a rotational moving direction of the developer carrying member and configured to urge the developer carrying member; wherein an amount of the toner on the developer carrying member per unit area in a region downstream of the urging roller and upstream of the developing position with respect to the rotational moving direction is not less than 50% of an amount of the toner and the developer carrying member per unit area in a region interposed between the electrode and the developer carrying member.

According to the present invention, a high-speed developing device is provided.

DESCRIPTION OF EMBODIMENTS

First Embodiment

A First Embodiment of the present invention will be described with reference to FIGS. 1 to 8. First, a schematic structure of an image forming apparatus will be described with reference to FIGS. 1 and 2.

[Image Forming Apparatus]

Figure 1:
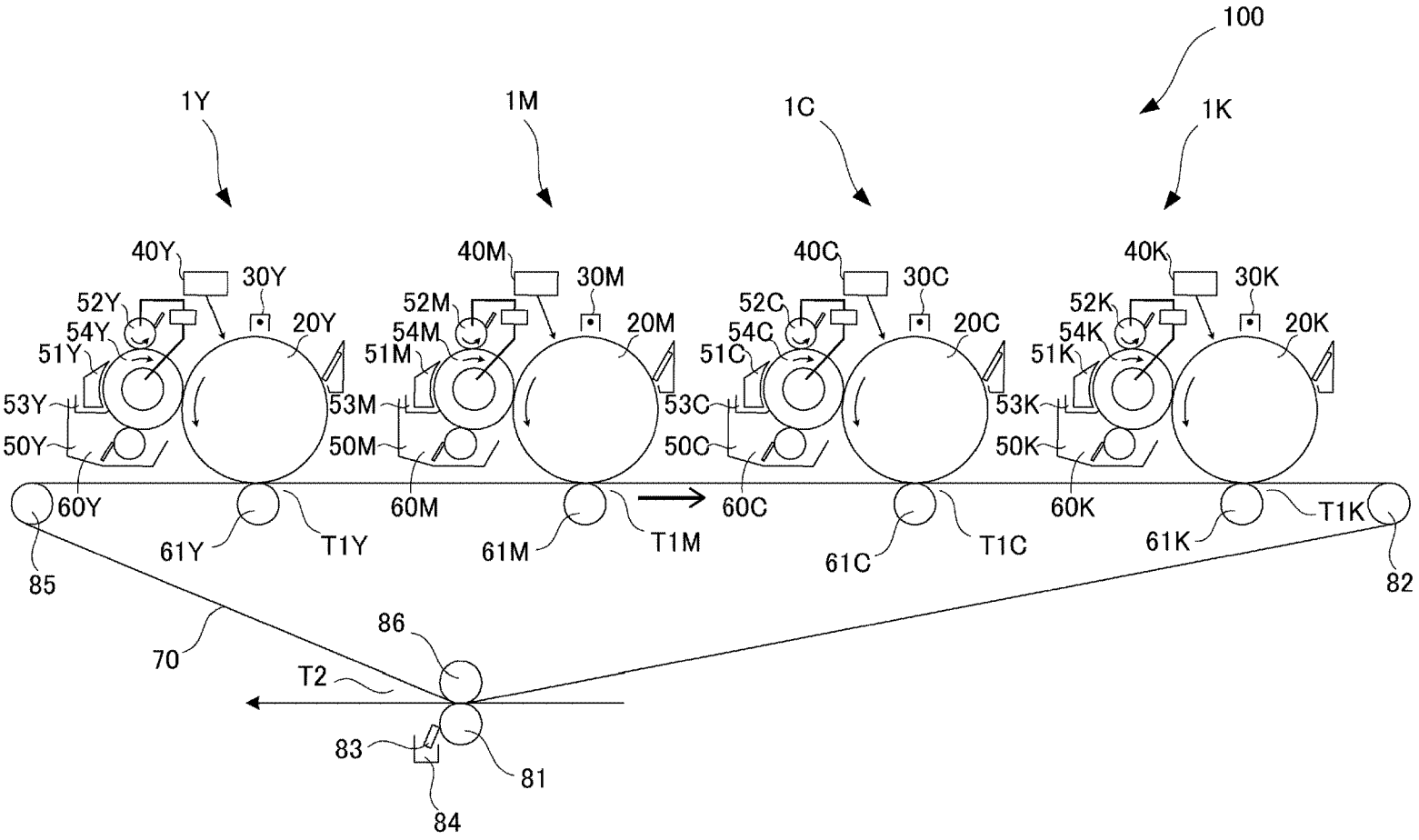
FIG. 1 is a schematic section view of an image forming apparatus according to a first embodiment of the present invention.

As shown in FIG. 1, an image forming apparatus 100 is a full-color image forming apparatus of an electrophotographic type in which four image forming portions 1Y, 1M, 1C and 1K are provided correspondingly to four colors of yellow (Y), magenta (M), cyan (C) and black (K), respectively. In this embodiment, the image forming apparatus 100 is of a tandem type in which the image forming portions 1Y, 1M, 1C and 1K are provided along a rotational direction of an intermediary transfer belt 70 described later. The image forming apparatus 100 forms a toner image on a recording material depending on an image signal from an external device communicatably connected with an image forming apparatus main assembly. As the recording material, a sheet material such as a sheet, a plastic film, a cloth or the like is used.

The respective image forming portions 1Y, 1M, 1C and 1K form toner images of the respective colors on photosensitive members 20Y, 20M, 20C and 20K as image bearing members with liquid developers each containing toner and a carrier liquid. Details of the image forming portions will be described later.

The intermediary transfer belt 70 as an intermediary transfer member is an endless belt stretched by a driving roller 82, a follower roller 85 and an inner secondary transfer roller 86, and is rotationally driven while being contacted to the photosensitive members 20Y, 20M, 20C and 20K and an outer secondary transfer roller 81. At positions opposing the photosensitive members 20Y, 20M, 20C and 20K through the intermediary transfer belt 70, primary transfer rollers 61Y, 61M, 61C and 61K are provided and form primary transfer portions T1Y, T1M, T1C and T1K. Further, at the primary transfer portions T1Y, TIM, T1C and T1K, the four color toner images are successively transferred superposedly from the photosensitive members 20Y, 20M, 20C and 20K onto the intermediary transfer belt 70, so that a full-color toner image is formed on the intermediary transfer belt 70.

Incidentally, for example, only a toner image of a single color such as black can also be formed on the intermediary transfer belt 70.

At a position opposing the inner secondary transfer roller 86 through the intermediary transfer belt 70, an outer secondary transfer roller 81 is provided and forms a secondary transfer portion T2. The single-color toner image or the full-color toner image formed on the intermediary transfer belt 70 is transferred onto the recording material at the intermediary transfer portion T2. The liquid developer which is not transferred on the recording material is removed by a cleaning device (not shown) contacting the intermediary transfer belt 70. To the outer secondary transfer roller 81, a blade 83 is contacted, and the liquid developer deposited on the outer secondary transfer roller 81 is scraped off by the blade 83 and is collected in a collecting portion 84. The toner image transferred on the recording material is fixed on the recording material by an unshown fixing device.

[Image Forming Portion]

Figure 2:
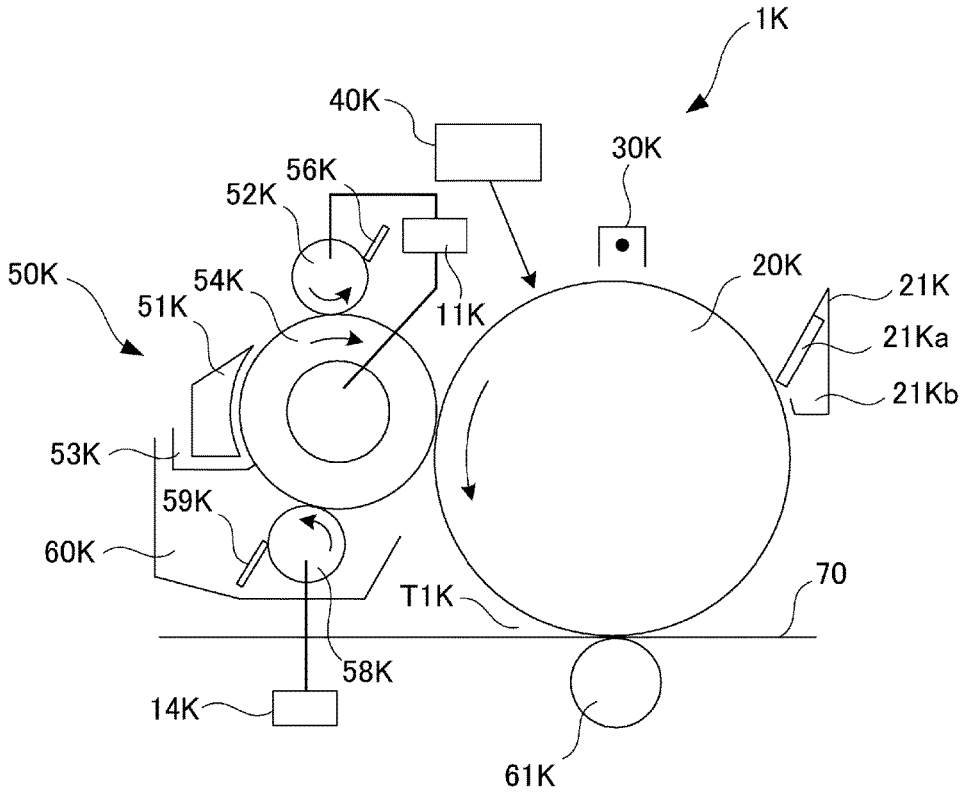
FIG. 2 is a schematic section view of an image forming portion.

The image forming portions 1Y, 1M, 1C and 1K will be described with reference to FIGS. 1 and 2. The image forming portions 1Y, 1M, 1C and 1K include developing devices 50Y, 50M, 50C and 50K, respectively. The developing devices 50Y, 50M, 50C and 50K accommodate liquid developers containing toner particles which develop the colors of yellow (Y), magenta (M), cyan (C) and black (K), respectively. The developing devices 50Y, 50M, 50C and 50K have functions of developing electrostatic latent images formed on the photosensitive members 20Y, 20M, 20C and 20K.

Incidentally, the four image forming portions 1Y, 1M, 1C and 1K have the substantially same constitution except that development colors are different from each other. Accordingly, in the following, the image forming portion 1K will be described as a representative with reference to FIG. 2, and other image forming portions will be omitted from description. Incidentally, as regards reference numerals or symbols of respective portions in FIG. 1, the portions are represented by adding suffixes (Y, M, C, K) to the reference numerals or symbols.

At a periphery of the photosensitive member 20K, along a rotational direction thereof, a charging device 30K for electrically charging the photosensitive member 20K, an exposure device 40K for forming the electrostatic latent image on the charged photosensitive member 20K, the developing device 50K, a cleaning device 21K and the like are provided.

The photosensitive member 20K is a photosensitive drum formed in a cylindrical shape and includes a cylindrical base material and a photosensitive layer formed on an outer peripheral surface of the base material, and is rotatable about a center axis thereof. The photosensitive member 20K is constituted by an organic photosensitive member or an amorphous silicon photosensitive member. The photosensitive member 20K is capable of carrying the electrostatic latent image described later. In this embodiment, the photosensitive member 20K rotates in the counterclockwise direction as shown by an arrow in FIG. 2.

The charging device 30K is a device for electrically charging the photosensitive member 20K. In this embodiment, a corona charger is used as the charging device 30K. The charging device 30K is provided upstream of a nip between the photosensitive member 20K and a developing roller 54K described later, and is supplied with a bias of the same polarity as a charge polarity of the toner from an unshown power (voltage) source, and thus electrically charges the photosensitive member 20K.

The exposure device 40K includes a semiconductor laser, a polygon mirror, an F-θ lens and the like, and the charged photosensitive member 20K is irradiated with laser light modulated correspondingly to the image signal, so that the electrostatic latent image is formed on the photosensitive member 20K. That is, the electrostatic latent image is carried on the photosensitive member 20K.

The developing device 50K is a device for developing the electrostatic latent image, formed on the photosensitive member 20K, with the toner of black (K). Details of the developing device 50K will be described later. The toner image formed on the photosensitive member 20K is primary-transferred onto the intermediary transfer belt 70 by applying a transfer voltage between the primary transfer roller 61K and the photosensitive member 20K. The cleaning device 21K includes a cleaning blade 21Ka and a collecting portion 21Kb and is capable of collecting the liquid developer on the photosensitive member 20K after the primary transfer.

[Developing Device]

Figure 3:
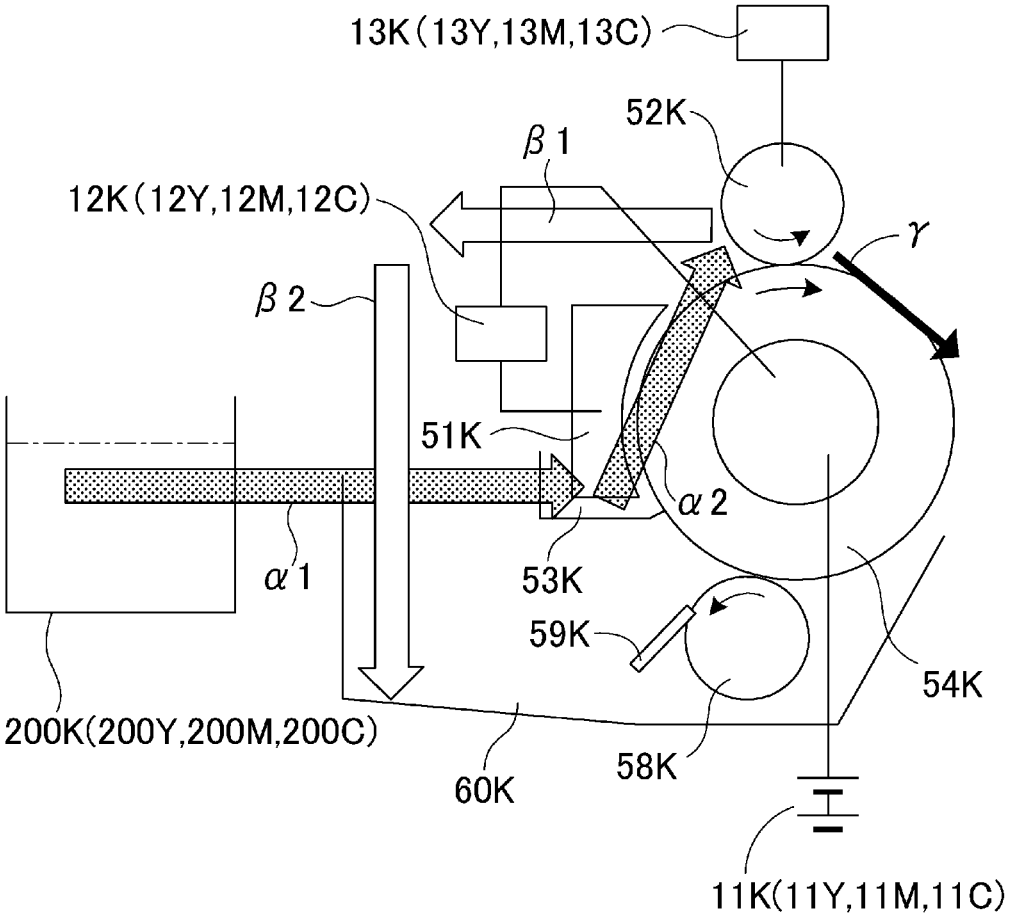
FIG. 3 is a schematic section view of a developing device illustrating flow of the liquid developer.

Next, a structure of the developing device 50K in this embodiment will be described with reference to FIGS. 2 and 3. The developing device 50K includes the developing roller 54K as a developer carrying member for carrying the liquid developer to the photosensitive member 20K. At a periphery of the developing roller 54K, a developer container 53K, a film forming electrode 51K, a drawing roller 52K as a compression member, and a development cleaning roller 58K as a collecting member are provided.

The developing roller 54K rotates while carrying the developer, and develops, with the toner at a position opposing the photosensitive member 20K, the electrostatic latent image carried on the photosensitive member 20K. The developing roller 54K is a cylindrical member and rotates about a center axis thereof in the clockwise direction indicated by an arrow in FIG. 3. The developing roller 54K includes a core metal of stainless steel, and on an outer peripheral surface of the core metal, an elastic member such as an electroconductive urethane, a resin layer and a rubber layer are formed.

The developer container 53K stores the liquid developer in which the toner particles of black are dispersed in the carrier liquid. The liquid developer used in this embodiment is prepared by adding the toner particles, in which a coolant such as a pigment is dispersed in a resin material and which are of for example 0.8 μm in average particle size, together with a dispersant, a toner charge control agent and a charge-directing agent into the carrier liquid such as an organic solvent. In this embodiment, a content (concentration) of the toner particles in the liquid developer was 1.5 weight %, for example. Further, in this embodiment, the surfaces of the toner particles are charged to a negative polarity in some amount.

The liquid developer stored in the developer container 53K is supplied from a mixer 200K. To the mixer 200K, the carrier liquid and the toner are supplied appropriately from a carrier container (tank) storing a carrier liquid for supply and a toner container (tank) storing toner for supply, respectively, for example. In the mixer 200, a stirring blade driven by an unshown motor is accommodated and mixes the supplied toner and the supplied carrier with each other by stirring thereof, and thus disperses the toner in the carrier liquid.

The film forming electrode 51K is disposed opposed to the developing roller 54K at a position upstream of a developing position with respect to the rotational direction of the developing roller 54K with a predetermined gap (first gap) from the developing roller 54K. In this embodiment, the gap between the film forming electrode 51K and the developing roller 54K is set at a uniform value. However, in the case where a difference in the gap between the film forming electrode 51K and the developing roller 54K is provided with respect to a longitudinal direction or a circumferential direction, the gap is a minimum value. Further, the film forming electrode 51K forms a film of the liquid developer, on the developing roller 54K, supplied from the developer container 53K so as to provide a desired toner content by being supplied with a predetermined film forming voltage from a film forming power (voltage) source 12K.

The drawing roller 52K is a roller, provided downstream of the film forming electrode 51K and upstream of the developing position with respect to the rotational direction of the developing roller 54K, for pressing the developing roller 54K. By this constitution, the toner layer in the liquid developer formed in the film on the developing roller 54K (developer carrying member) is compressed. That is, the drawing roller 52K shifts the toner particles, contained in the liquid developer formed in the film on the developing roller 54K, toward the developing roller 54K side under application of a predetermined drawing voltage from a drawing power (voltage) source 13K, and at the same time, draws and collects an excessive carrier liquid.

Such a drawing roller 52K is a cylindrical member formed of metal, and in this embodiment, a roller formed of stainless steel is used as the drawing roller 52K. The drawing roller 52K is contacted to the developing roller 54K and rotates about a center axis thereof in the counterclockwise direction as shown by an arrow in FIG. 2. The liquid developer raised from the developer container 53K and passed through the film forming electrode 51K is maintained in a predetermined amount on the developing roller 54K. For that reason, between the drawing roller 52K and the developing roller 54K, the liquid developer layer is stably formed in a thickness of about 3 μm and a width of about 5 mm with respect to the rotational direction.

The liquid developer is separate in the neighborhood of an exit of a portion between the drawing roller 52K and the developing roller 54K, and is carried on the respective rollers. At this time, as specifically described later, a predetermined potential difference is provided between the rollers so that when the liquid developer passes through between the drawing roller 52K and the developing roller 54K, the toner in the liquid developer shifts towards the developing roller 54K side. For this reason, the toner content in the liquid developer at the surface of the developing roller 54K remarkably increases, and becomes about 35 weight %, for example. The liquid developer carried on the drawing roller 52K is scraped off by the blade 56K.

The development cleaning roller 58K is provided downstream of the developing position with respect to the developing roller 54K, and collects the toner, which passes through the developing position and which remains on the developing roller 54K, under application of a collecting voltage from a collecting power (voltage) source 14K. That is, the development cleaning roller 58K collects the toner on the developing roller 54K under application of a collecting potential difference between itself and the developing roller 54K. The development cleaning roller 58K is contacted to the surface of the developing roller 54K and rotates in the counterclockwise direction indicated by an arrow in FIG. 2, and is a roller formed of stainless steel or aluminum, for example.

The toner collected by the development cleaning roller 58K is removed by a cleaning blade 59K as a cleaning means. The cleaning blade 59K is provided, with respect to the rotational direction of the development cleaning roller 58K, downstream of a position opposing the developing roller 54K so as to contact the development cleaning roller 58K. Then, the development cleaning roller 58K from which the toner is removed performs removal of the toner from the developing roller 54K again. The cleaning blade 59K is formed of aluminum in a thickness of 0.2 mm and is contacted counterdirectionally to the development cleaning roller 58K.

[Developing Device and Operation of Image Forming Apparatus]

Next, such a developing device and an operation of the image forming apparatus using the developing device will be described. Then, the developing device will be described by taking the developing roller 54K as an example. In FIG. 3, motion of the liquid developer is shown by arrows. To the developing roller 54K, for example, a developing voltage of −400V is applied from a developing power (voltage) source 11K. As shown by arrows α1 and α2, most of the liquid developer supplied from the mixer 200 to the developer container 53K is supplied to the gap between the film forming electrode 51K and the developing roller 54K. In this embodiment, the liquid developer of 1.5 weight % in toner content is supplied to the developer container 53K.

On the surface of the developing roller 54K, the liquid developer is carried when the liquid developer passes through the film forming electrode 51K. To the film forming electrode 51K, for example, a film forming voltage of −700V is applied from a film forming power (voltage) source 12K, and by a potential difference (300V) between the film forming electrode 51K and the developing roller 54K, the negatively charged toner is attracted toward the developing roller 54K side and is carried by the developing roller 54K. Thus, in this embodiment, a normal charge polarity of the toner is negative, and on the other hand, the negative voltages are applied to the developing roller 54K and the film forming electrode 51K, respectively. An absolute value of the voltage applied to the film forming electrode 51K is larger than an absolute value of the voltage applied to the developing roller 54K.

In the neighborhood of the exit of the film forming electrode 51K, the liquid developer is divided into the liquid developer carried on the surface of the developing roller 54K and the liquid developer flowing down on the back surface of the film forming electrode 51K. As shown by the arrows α1 and α2, the toner content of the liquid developer flowing down on the back surface of the film forming electrode 51K is lower than the toner content of the liquid developer as shown by the arrows α1 and α2. Incidentally, the toner content of the liquid developer flowing down on the back surface of the film forming electrode 51K was 0.7 weight %.

The developing roller 54K carrying the developer is then contacted to the drawing roller 52K, so that the drawing roller 52K is rotated at the same speed as the surface movement speed of the developing roller 54K in a surface movement direction of the developing roller 54K. To the drawing roller 52K, from a drawing power (voltage) source 13K, a drawing voltage higher by 50V-120V in absolute value than the developing voltage applied to the developing roller 54K. That is, when the developing voltage applied to the developing roller 54K is −400V, the drawing voltage applied to the drawing roller 52K is −450V to −520V. By the action of this drawing roller 52K, on the developing roller 54K, a thin layer coating of the liquid developer having the toner content of approximately 35 weight % is formed as indicated by an arrow γ. The toner content, of the liquid developer, indicated by an arrow γ is higher than the toner content, of the liquid developer, indicated by the arrows α1 and α2. Thereafter, by the rotation of the developing roller 54K, the thin layer coating of the liquid developer moves to the developing position between the developing roller 54K and the photosensitive member 20K.

At this time, about 51% of the liquid developer, with the liquid developer of 1.5 weight %, supplied to the developer container 53K passes through between the developing roller 54K and the drawing roller 52K and is coated in a thin layer on the developing roller 54K, and remaining 49% of the liquid developer flows down on the back surface of the film forming electrode 51K. That is, 50% or more of the toner of the liquid developer supplied to the predetermined gap between the film forming electrode 51K and the developing roller 54K passes through between the developing roller 54K and the drawing roller 52K and is carried (formed in a film) on the developing roller 54K. The liquid developer flowing down on the back surface of the film forming electrode 51K drops into a developing tub 60K as indicated by the arrows α1 and α2. The liquid developer dropped in developing tub 60K is thereafter adjusted in toner content by the mixer 200 or the like, and is supplied to the developing container 53K again.

The developing roller 54K after passing through the developing position is then contacted to the development cleaning roller 58K. To the development cleaning roller 58K, the collecting voltage of, e.g., −250V is applied from the collecting power source 14K. The toner which is not used for development at the developing position is electrophoresed to the development cleaning roller 58K by a potential difference between the development cleaning roller 58K and the developing roller 54K. Then, the toner is scraped off by the cleaning blade 59K.

Then, the operation of an entirety of the image forming apparatus will be described with reference to FIGS. 1 and 2. As the photosensitive member 20K, in this embodiment, an amorphous silicon photosensitive member is used. The surface of the photosensitive member 20K is electrically charged to about −800V by applying a voltage of about −4.5 kV to −5.5 kV to a wire of the charging device 30K which is a corona charger. After the charging, the electrostatic latent image is formed by the exposure device 40K so that an image portion potential is about 50V.

Between the developing roller 54K and the photosensitive member 20K at the developing position, an electric field is formed by a potential difference between the developing voltage of −400V applied to the developing roller 54K and the potential (image portion: −50V, non-image portion: −800V) of the electrostatic latent image on the photosensitive member 20K. Then, in accordance with the formed electric field, the toner particles are selectively moved to the image portion on the photosensitive member 20K. As a result, the toner image is formed on the photosensitive member 20K. The carrier liquid is not influenced by the electric field, and therefore, is separated at the exit between the developing roller 54K and the photosensitive member 20K in the developing position, and is deposited on both the developing roller 54K and the photosensitive member 20K.

The photosensitive member 20K passed through the developing position reaches the primary transfer portion which is a nip between itself and the intermediary transfer belt 70, and the toner image formed on the photosensitive member 20K is primary-transferred onto the intermediary transfer belt 70. At this time, to the primary transfer roller 61K, the primary transfer voltage of about +200V opposite in polarity to the charge polarity of the toner particles is applied, so that the toner particles on the photosensitive member 20K are primary-transferred onto the intermediary transfer belt 70, and only the carrier liquid remains on the photosensitive member 20K. The carrier liquid remaining on the photosensitive member 20K is scraped off by a cleaning blade 21Ka of a cleaning device 21K provided downstream of the primary transfer portion T1K and is collected in a collecting portion 21Kb.

The toner image primary-transferred on the intermediary transfer belt 70 moves toward the secondary transfer portion T2. At the secondary transfer portion T2, a secondary transfer voltage of +1000V is applied to the outer secondary transfer roller 81, and the inner secondary transfer roller 86 is maintained at 0V, so that the toner image on the intermediary transfer belt 70 is secondary-transferred onto the surface of the recording material fed to the secondary transfer portion T2.

In the image forming operation by the image forming apparatus, a toner movement efficiency in a subsequent toner particle movement process including movement of the toner particles from the developing roller 54K to the photosensitive member 20K is adjusted to a very high value of about 95% or more. For that reason, the respective developing devices 50Y, 50M, 50C and 50K are desired to accurately stabilize toner amounts on the developing rollers 54Y, 54M, 54C and 54K before the development of the electrostatic latent images into the toner images on the photosensitive members 20Y, 20M, 20C and 20K. As a result, stabilization of an image quality of the image outputted on the recording material can be realized.

[Film Formation]

Then, film formation of the liquid developer on the developing roller 54K by the film forming electrode 51K will be described specifically. As described above, in the respective developing devices 50Y, 50M, 50C and 50K, in order to form the films of the liquid developer on the developing rollers 54Y, 54M, 54C and 54K, a film forming voltage is applied to the film forming electrodes 51Y, 51M, 51C and 51K. a gap between one of the film forming electrodes 51Y, 51M, 51C and 51K and one of the developing rollers 54Y, 54M, 54C and 54K is set at 400 μm. Subsequently, description will be made by taking the developing device 50K as an example.

Figure 4:
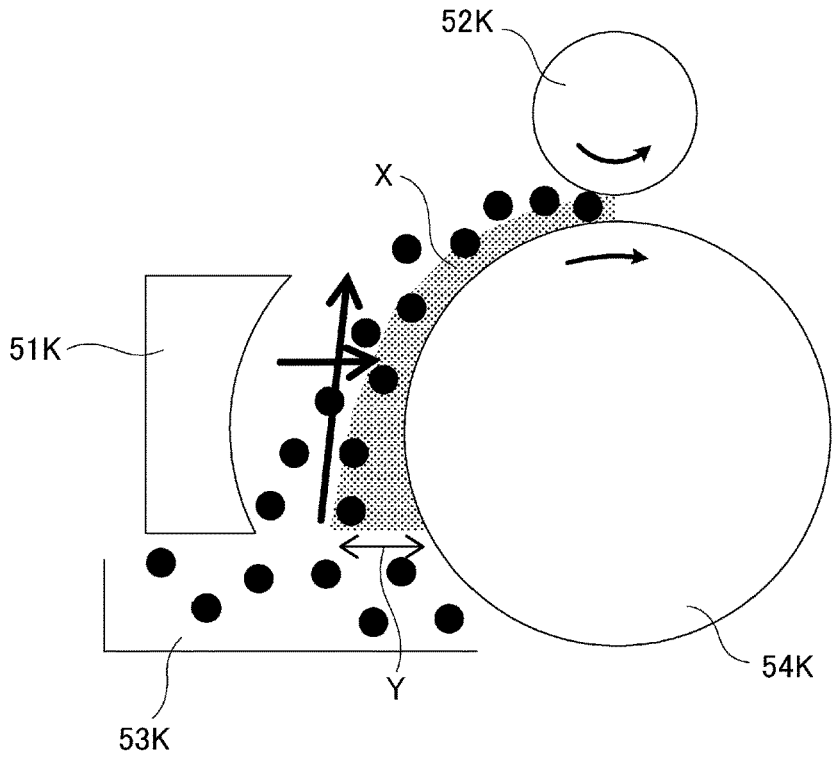
FIG. 4 is a schematic view of a electrode film formation on the developing roller.

Here, with reference to FIG. 4, a concept of the film formation by the film forming electrode 51K will be described. In FIG. 4, for explanation, the gap between the film forming electrode 51K and the developing roller 54K is largely indicated. At an entrance portion (a lower portion in the figure) of a film forming area between the film forming electrode 51K and the developing roller 54K, the toner particles (indicated by black dots) are dispersed substantially uniformly. As described above, under application of the film forming voltage, the toner moves gradually toward the developing roller 54K as the toner moves toward the downstream side (an upper portion in the figure) of the film forming area. The reason why the liquid developer containing the toner moves upward in the figure is that the liquid developer is raised with the rotation of the developing roller 54K. In the film forming area, there are two toner flowing directions consisting of a direction in which the toner moves with the rotation of the developing roller 54K and a direction in which the toner moves toward the developing roller 54K by the electric field.

At this time, in the film forming area, the toner moves toward the developing roller 54K, but of this toner, the toner moved toward the developing roller 54K than the gap between the developing roller 54K and the drawing roller 52K passes through between the developing roller 54K and the drawing roller 52K, so that the thin film is formed. As shown in FIG. 4, the toner in an area indicated by X from the entrance of the film forming area to the drawing roller 52K contributes to the formation of the thin film on the developing roller 54K. In other words, the toner existing in a range of a length Y at the entrance portion of the film forming area contributes to the formation of the thin film.

This condition is expressed by a calculation formula as described below. Here, the gap between the film forming electrode 51K and the developing roller 54K is a first gap, and the gap between the drawing roller 52K and the developing roller 54K is a second gap. However, the drawing roller 52K is pressed against the developing roller 54K, and therefore, it is difficult to measure the gap therebetween. Therefore, in this embodiment, as described above, a layer thickness of the liquid developer sandwiched between the drawing roller 52K and the developing roller 54K corresponds to the gap between the drawing roller 52K and the developing roller 54K, and therefore, the layer thickness of the liquid developer sandwiched between the drawing roller 52K and the developing roller 54K may also be measured. Or, as regards the gap between the drawing roller 52K and the developing roller 54K, the layer thickness of the liquid developer on the developing roller 54K in a region downstream of the drawing roller 52K and upstream of the developing position with respect to the rotational direction of the developing roller 54K is used.

$Y$=(toner moving speed by electric field)×(passing time of toner through first gap)+(interval of second gap(=layer thickness of liquid developer sandwiched between drawing roller 52*K* and developing roller 54*K*)) (formula 1)

Therefore, at the entrance portion of the film forming area, only the toner satisfying the formula 1 passes through between the drawing roller 52K and the developing roller 54K, so that the thin film of the liquid developer is formed on the developing roller 54K.

The toner moving speed by the electric field in the formula 1 is different among individual particles of the toner, and therefore, in consideration of this, the formula 1 is converted using an average toner moving speed ($m^2$/V·s), so that a formula 2 below was prepared.

$Y$ (m)=(average toner moving speed ($m^2$/V·s))×(potential difference between developing roller 54*K* and film forming electrode 51*K* (V))/(interval of first gap (m))×(first gap passing time (s))+(interval of second gap (m)) (formula 2)

Figure 5:
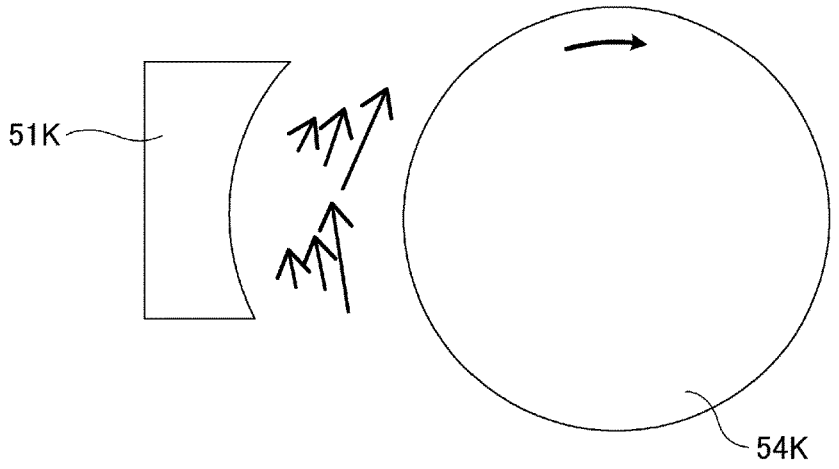
FIG. 5 is a schematic view illustrating a relationship between a speed of the liquid developer between the film electrode and the developing roller and a peripheral speed of the developing roller.

The first gap passing time in the above formulas 1 and 2, i.e., a time (nip time) in which the liquid developer exists between the film forming electrode 51K and the developing roller 54K will be described with reference to FIG. 5. In FIG. 5, arrows indicated between the film forming electrode 51K and the developing roller 54K (in the film forming area) represent a direction of a flow of the liquid developer, and an arrow indicated in the developing roller 54K represents the rotational direction of the developing roller 54K. Further, moving speeds of the liquid developer and a magnitude of the peripheral speed of the developing roller 54K are schematically shown by lengths of the arrows. In this embodiment, the peripheral speed of the developing roller 54K is 785 mm/s.

The speeds of the liquid developer in the film forming area is slower as the liquid developer approaches the film forming electrode 51K and is faster as the liquid developer approaches the developing roller as shown by the arrows. Accordingly, in the case where the moving speed of the liquid developer is considered as a simple model, the speed in the neighborhood of the film forming electrode 51K is substantially zero, and the speed in the neighborhood of the developing roller 54K is about 785 mm/s, so that the average speed is (785/2) mm/s.

However, the moving speed of the liquid developer is actually somewhat different from the above-described model depending on surface roughness of the developing roller 54K and the film forming electrode 51K. In this embodiment, the average moving speed of the liquid developer was about ⅓ of the speed of the developing roller 54K. In this embodiment, surface roughness Rz of the developing roller 54K is 1 μm, and surface roughness Rz of the film forming electrode 51K was also 1 μm. Thus, when also the flowing speed of the liquid developer is taken into consideration, the formula 2 is converted to the following formula 3:

$Y$ (m)=(average toner moving speed ($m^2$/V·s))×(potential difference between developing roller 54*K* and film forming electrode 51*K* (V))/(interval of first gap (m))×(length (m) of first gap with respect to rotational direction of developing roller 54*K*)/(peripheral speed (m/s) of developing roller×⅓)+(interval of second gap (m)) (formula 3)

Here, an average toner mobility in the first gap is μ($m^2$/V·s), and the potential difference between the developing roller 54K and the film forming electrode 51K is U (V). Further, the interval of the first gap is G1 (m), the length of the first gap with respect to rotational direction of developing roller 54K is L (m), the peripheral speed of the developing roller is v (m/s), and the interval of the second gap is G2 (m). In this case, the formula 3 can be represented by the following formula:

$$Y=\mu\times U/G1\times L/(v\times 1/3)+G2$$

Figure 6:
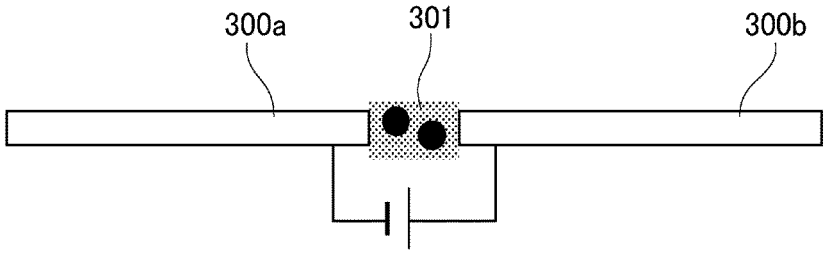
FIG. 6 is a schematic view illustrating a measuring method of a mobility.

Next, a measuring method of the average toner mobility will be described with reference to FIG. 6. The measurement of the average toner mobility was made using PIV (particle image velocimetry). Specifically, a voltage of 1V is applied between parallel flat plates in which an interval of a gap 301 between two metal plates 300*a* and 300*b* is 100 μm, and behavior of the toner is measured with a high-speed camera. A result thereof is subjected to PIV analysis, so that a speed of each of toner particles is measured. The speed is calculated as the speed per unit electric field is the mobility. The number of the toner particles to be measured is 100 particles to 1000 particles. In this embodiment, an average of values of the mobility of 200 toner particles was used as the average toner mobility.

[Thin Film Contribution Ratio]

A thin film contribution ratio during the film formation by the film forming electrode 51*k* will be described. The thin film contribution ratio indicates that what degree of the toner supplied from the developer container 53K to the film forming area between the film forming electrode 51K and the developing roller 54K contributes to the thin film formation. Accordingly, the thin film contribution ratio P (%) during the film formation can be represented by: P=Y/G1 (%). In other words, the thin film contribution ratio P is ability such that of the toner supplied to the film forming area, the toner having the average mobility can move in the gap (first gap) between the film forming electrode 51K and the developing roller 54K.

In summary, the thin film contribution ratio P (%) during the film formation is represented by the following formula:

$$P=\{\mu\times U/G1\times L/(v\times 1/3)+G2\}/G1\times 100 \quad \text{(formula 4)}$$

In this embodiment, as described above, the average speed of the liquid developer is about ⅓ of the speed of the developing roller 54K, and therefore the formula 4 represents the thin film contribution ratio in the case where the average speed of the liquid developer is about ⅓ of the peripheral speed v of the developing roller 54K.

Here, between the film forming electrode 51K and the developing roller 54K, particularly, the toner having high mobility to the electric field moves toward the developing roller 54K side, with the result that the toner passes through between the developing roller 54*a*K and the drawing roller 52K and easily contributes to the development. As a result, so that a selection phenomenon such that the toner with the high mobility is preferentially used and thus the toner with low mobility remains generates. Further, by long-term use, in the developing device, an amount of the toner with the low mobility increases. The toner with the low mobility is not readily electrophoresed in a step such as development or transfer compared with the toner with the high mobility, and therefore, there is a liability that an image quality changes such that a density of the image to be formed lowers.

Further, in general, electric density of the toner surface is roughly the same, and therefore, the toner with a large particle size has a large electric charge and high mobility, and the toner with a small particle size has a small electric charge and low mobility. For this reason, when the toner with the low mobility remains, there is a tendency that the toner with the small particle size remains in a large amount. As a result, there is a liability that the image is formed with the toners different in particle size between during use of the image forming apparatus at an initial stage and during use of the image forming apparatus after a lapse of a long term and thus the image quality changes.

Therefore, in this embodiment, the thin film contribution ratio P satisfies 100% or more. That is, $P=\{\mu\times U/G1\times L/(v\times 1/3)+G2\}/G1\times 100\geq 100$ is satisfied.

In the case of P=100%, this means that the toner with the average mobility has ability to move in the first gap G1. Further, in the case of P>100%, this means that the toner with the average mobility has ability to move in a distance further than the first gap G1. Accordingly, P≥100% is satisfied, it can be discriminated that almost all of the toner with the average mobility contributes to the formation of the thin film.

Figure 7:
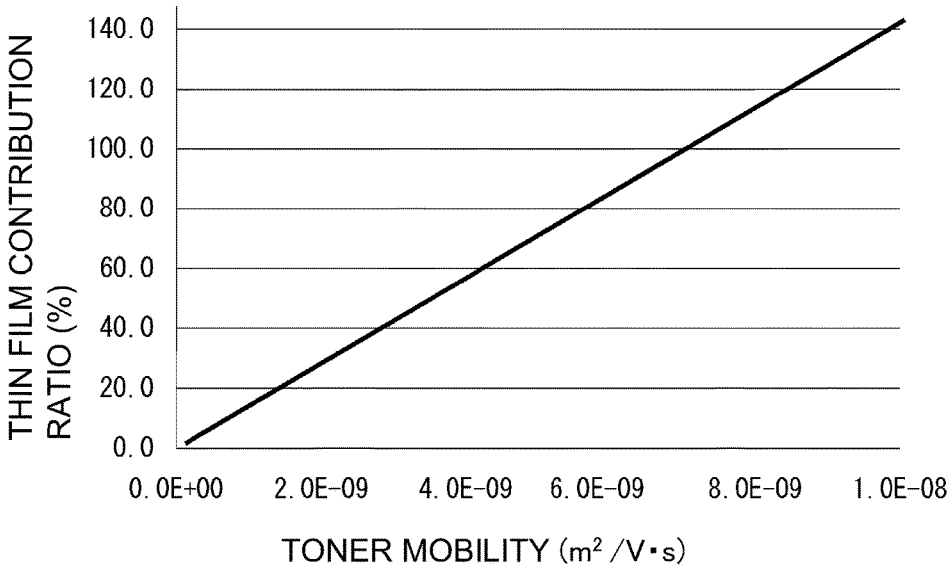
FIG. 7 is a graph showing a relationship between the mobility of the toner and a thin film contribution ratio.

In FIG. 7, a result of calculation of a relationship between the toner mobility and the thin film contribution ratio from the formula 4 in the constitution of this embodiment is shown. As is apparent from FIG. 7, it is understood that the toner in a larger amount contributes to the film formation with a higher degree of the toner mobility.

Here, calculation results in Comparison Example 1 in which the average toner mobility μ is low ($1.0\times10^{-9}$ ($m^2/V\cdot s$)) and in Embodiment 1 in which the average toner mobility is high ($7.0\times10^{-9}$ ($m^2/V\cdot s$)) and P≥100% is satisfied are shown in Table 1. In Table 1, the potential difference between the developing roller 54K and the film forming electrode 51K was a "potential difference U (V) at film forming electrode", and the interval of the first gap was a "gap distance G1 (m) from film forming electrode". Further, the length of the first gap with respect to rotational direction of developing roller 54K was a "nip length L (m) of film forming electrode", and the interval of the second gap was a "gap distance G2 (m) of drawing roller".

TABLE 1

| Items | Comparison Example 1 | Embodiment 1 |
|---|---|---|
| μ ($m^2/V\cdot s$) | 1.0E−09 | 7.0E−09 |
| U (V) | 300 | 300 |
| G1 (m) | 4.00E−04 | 4.00E−04 |
| L (m) | 0.020 | 0.020 |
| V (m/s) | 0.785 | 0.785 |
| LDAS/DRAS*[1] | 0.333 | 0.333 |
| G2 (m) | 3.0E−06 | 3.0E−06 |
| Y = (μm) | 60 | 404 |
| P (= Y/G1) (%) | 15.1 | 101.1 |

*[1]"LDAS/DRAS" is (Liquid developer average speed)/(Developing roller average speed).

As is apparent from Table 1, according to the calculation, the thin film contribution ratio P was 15.1% in Comparison Example 1 and was 101.1% in Embodiment 1. Accordingly, in Comparison Example 1, of the toner which is supplied to the first gap and which has the average toner mobility, 84.9% of the toner does not contribute to the formation of the thin film, i.e., the film formation, and flows down on the back surface of the film forming electrode 51K. On the other hand, in Embodiment 1, according to the calculation, of the toner which is supplied to the first gap and which has the average toner mobility, the toner which does not contribute to the film formation is 0%, and flows down on the back surface of the film forming electrode 51K. Comparison Example 1 and in Embodiment 1 are only different in toner mobility. Further, the toner with the high mobility contributes to the film formation in a large degree, and the toner with the low mobility contributes little to the film formation and drops into the developing tub 60K.

Figure 8:
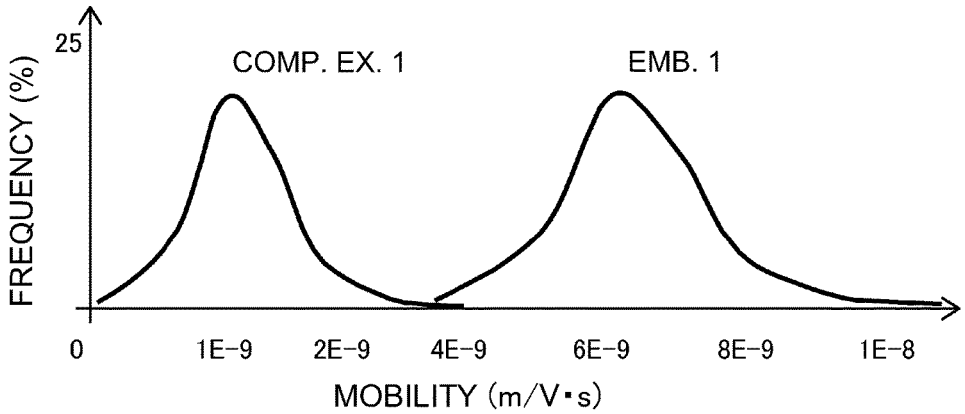
FIG. 8 shows mobility distributions of the toner used in a comparison example and Embodiment 1.

FIG. 8 shows mobility distributions of the toners used in Comparison Example 1 and in Embodiment 1. As shown in FIG. 8, the toner mobility in Embodiment 1 is high compared with the toner mobility in Comparison Example 1, and is $7.0\times10^{-9}$ ($m^2/V\cdot s$) as the average toner mobility. As described above, in this embodiment, the thin film contribution ratio P of the toner with the average toner mobility was 101.1% according to the calculation, and thus satisfies P 100%. Accordingly, it can be discriminated that almost all of the toner with the average toner mobility contributes to the film formation. Further, with higher toner mobility, the toner in a larger amount contributes to the formation of the thin film, and therefore, also the toner with the mobility higher than the average toner mobility contributes to the film formation. The toner mobility distribution is, as shown in FIG. 8, roughly represented by a normal distribution, and therefore, when the thin film contribution ratio P of the toner with the average toner mobility is 100% or more, it can be discriminated that 50% or more of the toner in the liquid developer supplied to the first gap contributes to the film formation. Incidentally, a method of calculating a ratio of the toner, contributing to the film formation, to the toner in the liquid developer supplied from the developer container 53K to the film forming area will be described. An amount of the toner in the liquid developer supplied to the film forming area is based on the toner content in the developer container 53K and is a toner amount per unit area of the developing roller 54K between the film forming electrode 51K and the developing roller 54K. The amount of the toner formed in the film is a toner amount per unit area of the developing roller 54K in a region downstream of the drawing roller 52*k* and upstream of the developing position with respect to the rotational direction of the developing roller 54K. For that reason, the ratio of the toner contributing to the film formation is represented by the following equation:

(Ratio of toner contributing to film formation)= (toner amount per unit area of developing roller 54*K* in region downstream of drawing roller 52*k* and upstream of developing position with respect to rotational direction of developing roller 54*K*)/(toner amount per unit area of developing roller 54*K* between film forming electrode 51*K* and developing roller 54*K*)×100.

Accordingly, in this embodiment, 50% or more of the toner in the liquid developer supplied to the first gap is caused to contribute to the film formation by using the liquid developer with the average toner mobility of $7.0\times10^{-9}$ ($m^2/V\cdot s$) or more. Accordingly, as described above, by the film forming roller 51K, about 51% of the toner passes through between the film forming electrode 51K and the developing roller 54K and is coated in a thin layer (formed in the film) on the developing roller 54K.

Thus, the liquid developer, with the average toner mobility, containing the toner satisfying the thin film contribution ratio P of 100% or more is obtained in the following manner, for example. That is, in order to obtain such a liquid developer, the toner mobility is increased, but the mobility can be enhanced to some extent by increasing an amount of a charge control agent capable of imparting electric charges to the toner and by optimizing a kind of the charge control agent. However, when the charge control agent is excessively increased, a resistance of the liquid developer lowers, so that there is a liability that leakage or the like is generated by the electric field at the developing position or the transfer portion.

For this reason, first, in order to prevent a lowering in resistance of the liquid developer to the extent possible, during manufacturing of the liquid developer, contamination with another material is prevented to the extent possible so that excessive ions are not mixed in the liquid developer. In addition, the charge control agent is added in the liquid developer so as to realize the thin film contribution ratio P of 100% or more. In this embodiment, metallic soap was used as the charge control agent, and an addition amount was 0.1 weight %.

In the case of this embodiment, a change in image quality due to long-term use can be suppressed. That is, in this embodiment, the thin film contribution ratio P of the toner with the average toner mobility is 100% or more, and therefore, 50% or more of the toner in the liquid developer supplied from the developer container 53K to the film forming area contributes to the film formation. For this reason, probability that the toner with the mobility lower than the average mobility contributes to the film formation increases. Accordingly, there is a tendency that the toner with the mobility lower than the average mobility gradually accumulates in the developing device, but the speed of the toner is slower than that of the toner in the case where the thin film contribution ratio P of the toner with the average toner mobility is less than 100%, and therefore, the change in image quality due to long-term use can be suppressed. Further, the change in image quality can be suppressed for a long term, and therefore, a frequency of exchange of the liquid developer can be decreased. In other words, a lifetime of the liquid developer can be prolonged.

On the other hand, in the case of Comparison Example 1, the amount of the toner with the low mobility is large in the liquid developer, so that even at an initial stage of use, the thin film contribution ratio is 15.1% or less. For this reason, the toner with the low mobility is predominant in the developing device, so that there is a liability that the change in image quality due to long-term use generates. In this case, a process of exchanging all of the developer is performed in some instances, so that the lifetime of the liquid developer is shortened.

Second Embodiment

A Second Embodiment of the present invention will be described with reference to FIGS. 1 to 4. In the First Embodiment described above, the case where the thin film contribution ratio of 100% or more was satisfied when the average speed of the liquid developer was ⅓ of the peripheral speed v of the developing roller 54K was described. On the other hand, in this embodiment, the thin film contribution ratio of 100% or more is satisfied when the average speed of the liquid developer was ½ of the peripheral speed v of the developing roller 54K. Other constitutions and actions are similar to those in the First embodiment, and therefore, in the following, a difference from the First Embodiment will be principally described. Incidentally, also in this embodiment, similarly as in the First Embodiment, the image forming portion 1K for black will be described as an example, but other image forming portions are similarly constituted.

In the First Embodiment described above, the surface roughness Rz of the developing roller 54K is 1 μm, and the surface roughness Rz of the film forming electrode 51K is also 1 μm, but for example, the surface of the developing roller 54K is roughened more than the surface of the film forming electrode 51K in some instances. In this case, a feeding property of the liquid developer by the developing roller 54K is high, so that the average speed of the liquid developer is high. In this embodiment, the surface roughness Rz of the developing roller 54K is 2 μm, and the surface roughness Rz of the film forming electrode 51K is 1 μm.

Thus, in this embodiment, the average speed of the liquid developer is high, and therefore, a flowing speed of the liquid developer is made ½ of the peripheral speed v of the developing roller 54K. That is, in the case where the simple model is considered as described above, on the basis of consideration such that the average speed of the liquid developer is about ½ of the peripheral speed v of the developing roller 54K, the average speed of the liquid developer is set. As a result, even when the flowing speed of the liquid developer somewhat fluctuates by the influence of the surface roughness of the developing roller 54K and the surface roughness of the film forming electrode 51K, the thin film contribution ratio of 100% or more can be satisfied.

Accordingly, in this embodiment, the thin film contribution ratio P, of 100% or more, represented by the following formula 5 can be satisfied.

$$P=\{\mu\times U/G1\times L/(v\times 1/2)+G2\}/G1\times 100 \quad \text{(formula 5)}$$

Specifically, by using the liquid developer with the average toner mobility of $1.1\times10^{-8}$ ($m^2/V\cdot s$) or more, 50% or more of the toner in the liquid developer supplied to the first gap contributes to the film formation.

Here, calculation results in Comparison Example 2 in which the average toner mobility μ is low ($1.0\times10^{-9}$ ($m^2/V\cdot s$)) and in Embodiment 2 in which the average toner mobility is high ($1.1\times10^{-8}$ ($m^2/V\cdot s$)) and P≥100% is satisfied are shown in Table 2.

TABLE 2

| Items | Comparison Example 2 | Embodiment 2 |
|---|---|---|
| μ ($m^2/V\cdot s$) | 1.0E−09 | 1.1E−08 |
| U (V) | 300 | 300 |

TABLE 2-continued

| Items | Comparison Example 2 | Embodiment 2 |
|---|---|---|
| G1 (m) | 4.00E−04 | 4.00E−04 |
| L (m) | 0.020 | 0.020 |
| V (m/s) | 0.785 | 0.785 |
| LDAS/DRAS*1 | 0.500 | 0.500 |
| G2 (m) | 3.0E−06 | 3.0E−06 |
| Y = (μm) | 41 | 423 |
| P (= Y/G1) (%) | 10.3 | 105.8 |

*1"LDAS/DRAS" is (Liquid developer average speed)/(Developing roller average speed)

As is apparent from Table 2, according to the calculation, the thin film contribution ratio P was 10.3% in Comparison Example 2 and was 105.8% in Embodiment 2. In this embodiment, in order to make the toner mobility higher than that in the First Embodiment, the metallic soap was used as the charge control agent, and the addition amount was 0.2 weight %. In the case of this embodiment, even when the flowing speed of the liquid developer is fast and the film forming time is short, the change in image quality due to the long-term use can be suppressed and the lifetime of the liquid developer can be prolonged.

Third Embodiment

A Third Embodiment of the present invention will be described with reference to FIGS. 1 to 4. In the Second Embodiment described above, the case where the thin film contribution ratio of 100% or more was satisfied when the average speed of the liquid developer was ½ of the peripheral speed v of the developing roller 54K was described. On the other hand, in this embodiment, the thin film contribution ratio of 100% or more is satisfied when the average speed of the liquid developer was equal to the peripheral speed v of the developing roller 54K. Other constitutions and actions are similar to those in the First embodiment, and therefore, in the following, a difference from the First Embodiment will be principally described. Incidentally, also in this embodiment, similarly as in the First Embodiment, the image forming portion 1K for black will be described as an example, but other image forming portions are similarly constituted.

In theory, the speed of the liquid developer between the film forming electrode 51K and the developing roller 54K is not faster than the peripheral speed v of the developing roller 54K. For this reason, when the average speed of the liquid developer was equal to the peripheral speed v of the developing roller 54K, even in the case where the developing roller 54*k* has any feeding property of the liquid developer, the thin film contribution ratio of 100% or more can be satisfied.

Accordingly, in this embodiment, the thin film contribution ratio P, of 100% or more, represented by the following formula 6 can be satisfied.

$$P=\{\mu\times U/G1\times L/v+G2\}/G1\times 100 \quad \text{(formula 6)}$$

Specifically, by using the liquid developer with the average toner mobility of $2.1\times10^{-8}$ ($m^2/V\cdot s$) or more, 50% or more of the toner in the liquid developer supplied to the first gap contributes to the film formation.

In this embodiment, in order to make the toner mobility higher than those in the First and second Embodiments, the metallic soap was used as the charge control agent, and the addition amount was 0.6 weight %. In addition thereto, as regards the toner binder, the coolant, the carrier, and the like during the manufacturing, those having very high purities were used. In the case of this embodiment, even in the case where the developing roller 54*k* has any feeding property of the liquid developer, the change in image quality due to the long-term use can be suppressed and the lifetime of the liquid developer can be prolonged.

Fourth Embodiment

A Fourth Embodiment of the present invention will be described with reference to FIGS. 9 and 10 while making reference to FIGS. 1 to 4. In the above-described embodiments, 50% or more of the toner in the liquid developer supplied from the developer container 53K to the film forming area is caused to contribute to the film formation principally by increasing the toner mobility. On the other hand, in this embodiment, 50% or more of the toner in the liquid developer supplied from the developer container 53K to the film forming area is caused to contribute to the film formation principally by adjusting the potential difference between the film forming electrode 51K and the developing roller 54K. Other constitutions and actions are similar to those in the First embodiment, and therefore, in the following, a difference from the First Embodiment will be principally described. Incidentally, also in this embodiment, similarly as in the First Embodiment, the image forming portion 1K for black will be described as an example, but other image forming portions are similarly constituted.

Realization that 50% or more of the toner in the liquid developer supplied from the developer container 53K to the film forming area is caused to contribute to the film formation can also be achieved by increasing the potential difference between the film forming electrode 51K and the developing roller 54K. However, this potential difference is excessively increased, the toner excessively moves toward the developing roller 54K, it becomes difficult to carry out the development of the electrostatic latent image into the toner image on the photosensitive member 20K and the cleaning of the developing roller surface with the developing cleaning roller 58K. For that reason, in this embodiment, an optimum potential difference between the film forming electrode 51K and the developing roller 54K is determined in the following manner.

Figure 9:
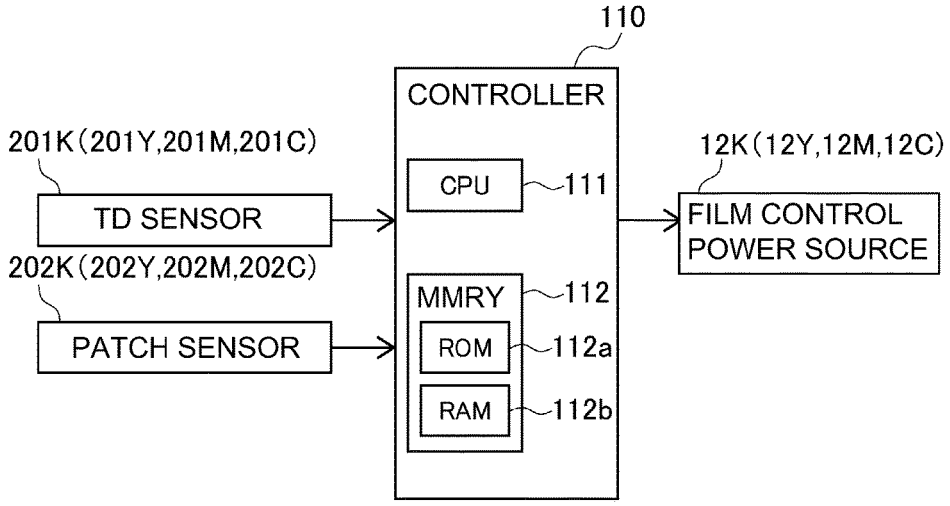
FIG. 9 is a control block diagram of the image forming apparatus according to a fourth embodiment of the present invention.
Figure 10:
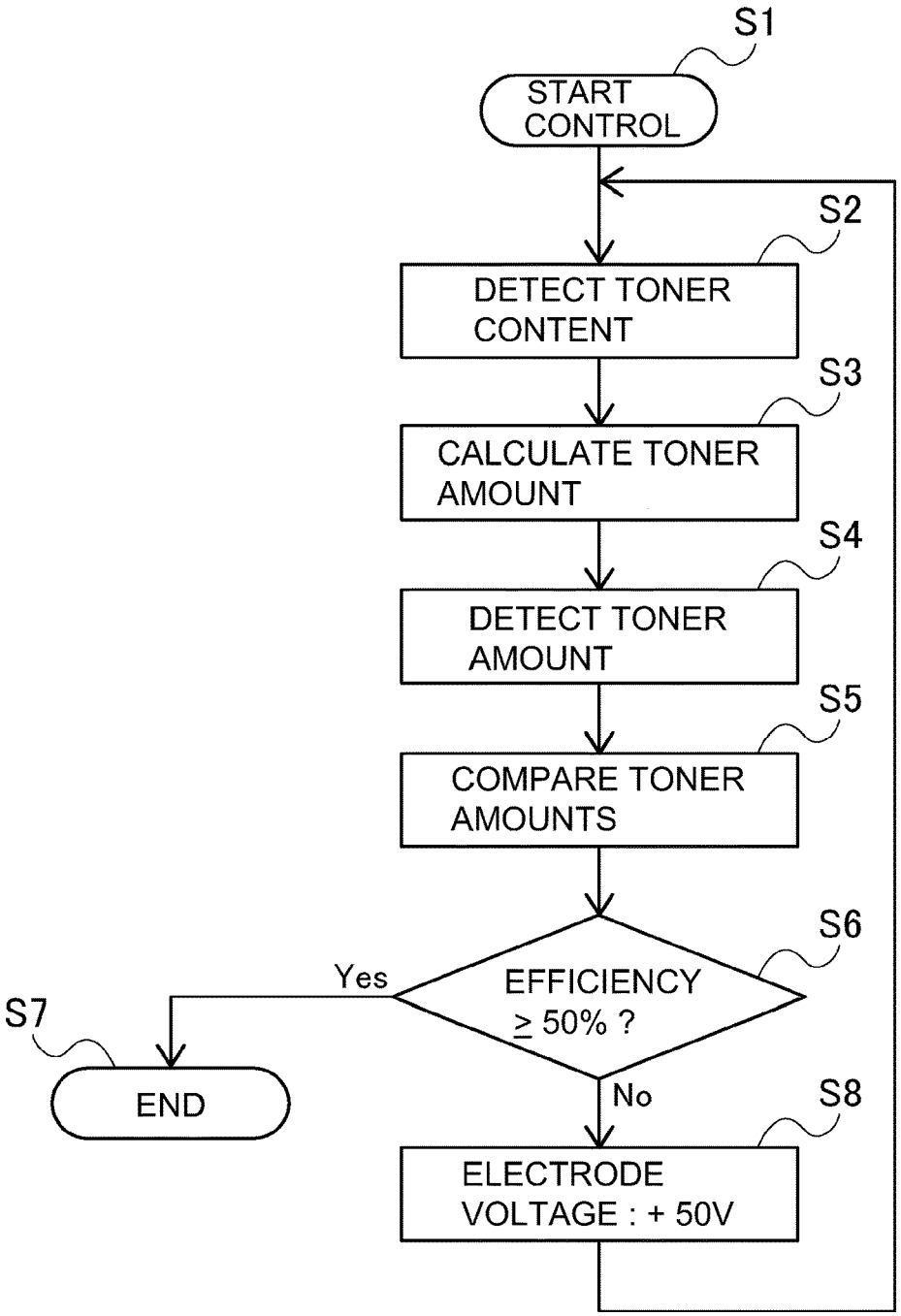
FIG. 10 is a flow chart an voltage control for the film electrode according to the fourth embodiment.

First, as shown in FIG. 9, a controller 110 as a control means, a CPU (central processing unit) 111 is provided. In a memory 112, an ROM (read only memory) 112*a* is provided. In the ROM 112*a*, a program corresponding to a control procedure is stored. The CPU 111 controls respective portions while reading data and programs written in advance in the ROM 112*a*. In the memory 112, also an RAM (random access memory) 112*b* in which operation data and input data read from respective sensors are stored is provided. The CPU 111 effects control by making reference to the data stored in the RAM 112*b* on the basis of the above-described programs or the like.

Further, the CPU 111 is also connected with a TD sensor 201K as a first detecting means capable of detecting the toner content (density) of the liquid developer in the mixer 200 causing the liquid developer to circulate between itself and the developer container 53K and is capable of using a result of detection in real time. Incidentally, the liquid developer in the mixer 200 is supplied to the developer container 53K, and therefore, the toner content of the liquid developer stored in the developer container 53K is substantially equal to the toner content of the liquid developer stored in the mixer 200. For this reason, by the TD sensor 201K disposed in the mixer 200, the toner content of the liquid developer stored in the developer container 53K is detectable. The TD sensor 201K may also be directly disposed in the developer container 53K.

In this embodiment, a patch sensor 202K capable of detecting the toner amount of the toner image formed on the intermediary transfer belt 70 is provided. The patch sensor 202K as a second detecting means is disposed further downstream of the downstream-most image forming portion 1K and upstream of the secondary transfer portion T2 with respect to the rotational direction of the intermediary transfer belt 70. The patch sensor 202K includes a light-emitting portion and a light-receiving portion, and emits light from the light-emitting portion toward the surface of the intermediary transfer belt 70 and receives the light, reflected from the intermediary transfer belt surface, by the light-receiving portion, and thus detects a reflected light quantity. The reflected light quantity changed depending on the toner amount of the toner image, and therefore, by detecting the reflected light quantity with the patch sensor 202K, the toner amount of the toner image can be detected.

Control for detecting the toner amount of the toner image is carried out, for example, during a sheet interval during an image forming job. For example, a control toner image (patch) is formed on the intermediary transfer belt 70 for each predetermined number of sheets, and the toner amount of the control toner image is detected by the patch sensor 202K. The CPU 111 is also connected with the patch sensor 202K.

Incidentally, the image forming job is carried out in a period from a start of image formation, started on the basis of a print signal for forming the image on the recording material, to an end of an image forming operation. Specifically, the period refers to a period from during pre-rotation after receiving the print signal (after input of the image forming job) to post-rotation, and includes an image forming period and the sheet interval (during non-image formation). Further, the pre-rotation refers to a period in which as a preparatory operation before the image formation, rotation of the photosensitive member and the intermediary transfer belt is started and various voltages are successively applied and adjusted. The post-rotation refers to a period in which as an operation after the image formation, the various voltages are successively applied and finally the rotation of the photosensitive member and the intermediary transfer belt is stopped. The sheet interval is a period corresponding to an interval between a recording material and a subsequent recording material which consequently pass through the secondary transfer portion T2.

The CPU 111 is also connected with, as a control destination, the film forming power source 12K capable of applying a film forming voltage to the film forming electrode 51K. The film forming power source 12K is a voltage source capable of variably applying a voltage to between the developing roller 54K and the film forming electrode 51K.

Next, a control flow for determining the potential difference between the film forming electrode 51K and the developing roller 54K will be described with reference to FIG. 10. When the control is started (S1), the CPU 111 causes the TD sensor 201K to detect the toner content of the liquid developer in the mixer 200 (S2). Then, on the basis of a detection result of the toner content, the CPU 111 calculates the toner amount on the intermediary transfer belt 70 where a film forming efficiency is 50% (S3). The film forming efficiency is a ratio such that the toner in the liquid developer supplied from the developer container 53K to the gap (film forming area) between the film forming electrode 51K and the developing roller 54K is formed in the film on the developing roller 54K.

Here, a volume of the film forming area is known. Further, a toner moving efficiency in a toner particle movement process including movement of the toner from the developing roller 54*k* to the photosensitive member 20K and including subsequent movement of the toner is about 95% or more. For this reason, when the toner content of the liquid developer in the developer container 53 K is known, the toner amount on the intermediary transfer belt 70 at the film forming efficiency of 50% can be calculated.

Then, at predetermined timing, the control toner image (patch) is formed on the intermediary transfer belt 70, and the toner amount of the control toner image is detected by the patch sensor 202K (S4). The CPU 111 compares the toner amount detected in S3 and the toner amount detected in S4 with each other (S5). Then, the CPU 111 discriminates whether or not the film forming efficiency is 50% or more (S6). That is, when the toner amount (actually measured value) detected in S4 is not less than the toner amount (calculated value) calculated in S3, the CPU 111 can discriminate that the film formation can be carried out with the film forming efficiency of 50% or more in the film forming area.

In S6, when the CPU 111 discriminates that the film forming efficiency is 50% or more (Yes of S6), the control ends (S7). On the other hand, in S6, when the CPU 111 discriminates that the film forming efficiency is less than 50% (No of S6), in order to increase the film forming efficiency, the CPU 111 controls the film forming power source 12K and thus increases the film forming voltage of 50V (S8). Then, the sequence is returned to S2, and similar control is repeated. Incidentally, at this time, an upper limit of the voltage applied to the film forming power source 12K may also be determined in advance. Further, in this case, when the film forming efficiency is not 50% or more even in the case where the film forming voltage reaches an upper limit, an error may also be notified to an operator.

In such an embodiment, by properly controlling the potential difference between the film forming electrode 51K and the developing roller 54K as described above, 50% or more of the toner in the liquid developer supplied from the developer container 53K to the film forming area can be caused to contribute to the film formation. That is, the film forming efficiency can be made 50% or more. For this reason, the probability that the toner with the mobility lower than the average mobility contributes to the film formation increases, so that the change in image quality due to the long-term use can be suppressed and the lifetime of the liquid developer can be prolonged.

Further, in the case of this embodiment, the film forming efficiency can be made 50% or more even when the toner mobility is not increased. Incidentally, either of the above-described embodiments may also be combined with this embodiment. That is, the control in this embodiment may also be carried out using the liquid developer in either of the above-described embodiments.

Other Embodiments

Other than the constitutions in the above-described embodiments, in order to make the film forming efficiency 50% or more, a constitution in which the gap between the film forming electrode 51K and the developing roller 54K is set may also be employed.

Further, other than the constitutions in the above-described embodiments, in order to make the film forming efficiency 50% or more, a constitution in which a force for urging the drawing roller 52K against the developing roller 54K is set may also be employed.

In the above-described embodiments, the constitution in which the developing cleaning roller was used as the collecting member was described, but the collecting member may also be a member, such as a blade other than the roller, which does not rotate when the member can collect the toner on the developing roller by the potential difference. However, in the case where the lifetime of the developing roller is taken into consideration, the collecting member may preferably be a rotatable member rotating at the same peripheral speed as the developing roller. Further, the intermediary transfer member may also be, for example, an intermediary transfer drum other than the intermediary transfer belt.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2017-008952 filed on Jan. 20, 2017, which is hereby incorporated by reference herein in its entirety.

What is claimed is:

1. A developing device comprising:

a rotatable developer carrying member configured to carry liquid developer including toner and carrier liquid to develop an electrostatic latent image carried on an image bearing member, at a developing position;

a developer container configured to store the liquid developer;

an electrode provided opposed to said developer carrying member with a predetermined gap therebetween and configured to form an electric field for moving the toner in the liquid developer supplied from said developer container into the predetermined gap, toward said developer carrying member; and an urging roller provided downstream of said electrode and upstream of the developing position with respect to a rotational moving direction of said developer carrying member and configured to urge said developer carrying member, wherein an amount of the toner on said developer carrying member per unit area in a region downstream of said urging roller and upstream of the developing position with respect to the rotational moving direction is not less than 50% of an amount of the toner on said developer carrying member per unit area in a region interposed between said electrode and said developer carrying member.

2. A developing device according to claim 1, wherein a potential difference between said electrode and said developer carrying member is set such that the amount of the toner on said developer carrying member per unit area in the region downstream of said urging roller and upstream of the developing position with respect to the rotational moving direction is not less than 50% of the amount of the toner on said developer carrying member per unit area in the region interposed between said electrode and said developer carrying member.

3. A developing device according to claim 2, wherein said electrode and said developer carrying member are supplied with voltages having the polarity which is the same as a regular charge polarity of the toner, and an absolute value of the voltage applied to said electrode is larger than an absolute value of the voltage applied to said developer carrying member.

4. A developing device according to claim 3, wherein the gap is set such that the amount of the toner on said developer carrying member per unit area in the region downstream of said urging roller and upstream of the developing position with respect to the rotational moving direction is not less than 50% of the amount of the toner on said developer carrying member per unit area in the region interposed between said electrode and said developer carrying member.

5. An apparatus according to claim 4, wherein an urging force of said urging roller is set such that the amount of the toner on said developer carrying member per unit area in the region downstream of said urging roller and upstream of the developing position with respect to the rotational moving direction is not less than 50% of the amount of the toner and said developer carrying member per unit area in the region interposed between said electrode and said developer carrying member.

6. A developing device comprising:

a rotatable developer carrying member configured to carry liquid developer including toner and carrier liquid to develop an electrostatic latent image carried on an image bearing member, at a developing position;

a developer container configured to store the liquid developer;

an electrode provided opposed to said developer carrying member with a predetermined gap therebetween and configured to form an electric field for moving the toner in the liquid developer supplied from said developer container into the predetermined gap, toward said developer carrying member; and an urging roller provided downstream of said electrode and upstream of the developing position with respect to a rotational moving direction of said developer carrying member and configured to urge said developer carrying member, wherein an average mobility $\mu(m^2/V\cdot s)$ of the toner in the liquid developer, a potential difference U (V) between said developer carrying member and said electrode, the gap G1 (m), a length L (m) of a region filled with the liquid developer between said electrode and said developer carrying member in a rotational direction of the developer carrying member, a peripheral speed v (m/s) of said developer carrying member, and layer thickness G2 (m) of the liquid developer in a region downstream of said urging roller and upstream of the developing position with respect to the rotational direction, satisfy $$\{\mu\times U/G1\times L/(v\times 1/3)+G2\}/G1\times 100\geq 100.$$

7. A developing device according to claim 6, wherein $\{\mu\times U/G1\times L/(v\times 1/2)+G2\}/G1\times 100\geq 100$ is satisfied.

8. A developing device according to claim 6, wherein $\{\mu\times U/G1\times L/v+G2\}/G1\times 100\geq 100$ is satisfied.

9. A developing device according to claim 6, wherein the average mobility of the toner is not less than $7.0\times 10^{-9}$ $(m^2/V\cdot s)$.

10. A developing device comprising:

a rotatable developer carrying member configured to carry liquid developer including toner and carrier liquid to develop an electrostatic latent image carried on an image bearing member, at a developing position;

a developer container configured to store the liquid developer;

an electrode provided opposed to said developer carrying member with a predetermined gap therebetween and configured to form an electric field for moving the toner in the liquid developer supplied from said developer container into the predetermined gap, toward said developer carrying member; and an urging roller provided downstream of said electrode and upstream of the developing position with respect to a rotational moving direction of said developer carrying member and configured to urge said developer carrying member;

wherein an average mobility $\mu(m^2/V\cdot s)$ of the toner in the liquid developer, a potential difference U (V) between said developer carrying member and said electrode, the gap G1 (m), a length L (m) of a region filled with the liquid developer between said electrode and said developer carrying member in a rotational direction of the developer carrying member, a peripheral speed v (m/s) of said developer carrying member, and layer thickness G2 (m) of the liquid developer, satisfy $$\{\mu\times U/G1\times L/(v\times 1/2)+G2\}/G1\times 100\geq 100.$$

11. A developing device according to claim 10, wherein $\{\mu\times U/G1\times L/(v\times 1/2)+G2\}/G1\times 100\geq 100$ is satisfied.

12. A developing device according to claim 10, wherein $\{\mu\times U/G1\times L/v+G2\}/G1\times 100\geq 100$ is satisfied.

13. A developing device according to claim 12, wherein the average mobility of the toner is not less than $7.0\times 10^{-9}$ $(m^2/V\cdot s)$.

14. A developing device comprising:

a rotatable developer carrying member configured to carry liquid developer including toner and carrier liquid to develop an electrostatic latent image carried on an image bearing member, at a developing position;

a developer container configured to store the liquid developer;

an electrode provided opposed to said developer carrying member with a predetermined gap therebetween and configured to form an electric field for moving the toner in the liquid developer supplied from said developer container into the predetermined gap, toward said developer carrying member; and an urging roller provided downstream of said electrode and upstream of the developing position with respect to a rotational moving direction of said developer carrying member and configured to urge said developer carrying member, wherein an average mobility of the toner is not less than $7.0\times 10^{-9}$ $(m^2/V\cdot s)$.

* * * * *